United States Patent [19]

Fisher

[11] Patent Number: 4,718,869

[45] Date of Patent: Jan. 12, 1988

[54] MARINE ENGINE THROTTLE/TRANSMISSION HYDRAULIC ACTUATOR

[76] Inventor: Robert C. Fisher, 4200 N. Dixie Highway, West Palm Beach, Fla. 33407

[21] Appl. No.: 8,754

[22] Filed: Jan. 30, 1987

[51] Int. Cl.[4] ..... B63H 23/04

[52] U.S. Cl. ..... 440/1; 440/86; 440/87; 91/358 R

[58] Field of Search ..... 440/1, 75, 84, 86, 87; 74/480 B; 91/189 R, 191, 192, 170 R, 358 R, 396, 527

[56] References Cited

U.S. PATENT DOCUMENTS

| | | | |
|---|---|---|---|
| 2,867,132 | 1/1959 | Schroeder | 440/87 |
| 3,407,738 | 10/1968 | Bosch | 91/382 |
| 3,967,533 | 7/1976 | Tyler | 91/382 |
| 4,231,316 | 11/1980 | Bland et al. | 440/86 |
| 4,242,942 | 1/1981 | Bartholomaus et al. | 91/358 R |
| 4,432,734 | 2/1984 | Bland et al. | 440/1 |
| 4,525,149 | 6/1985 | Broughton et al. | 440/1 |

*Primary Examiner*—Joseph F. Peters, Jr.
*Assistant Examiner*—Stephen P. Avila
*Attorney, Agent, or Firm*—Lyman R. Lyon

[57] ABSTRACT

A single-lever hydraulic control system for marine applications which controls both engine throttle and the transmission engaged therewith, and which allows for multiple control stations.

6 Claims, 1 Drawing Figure

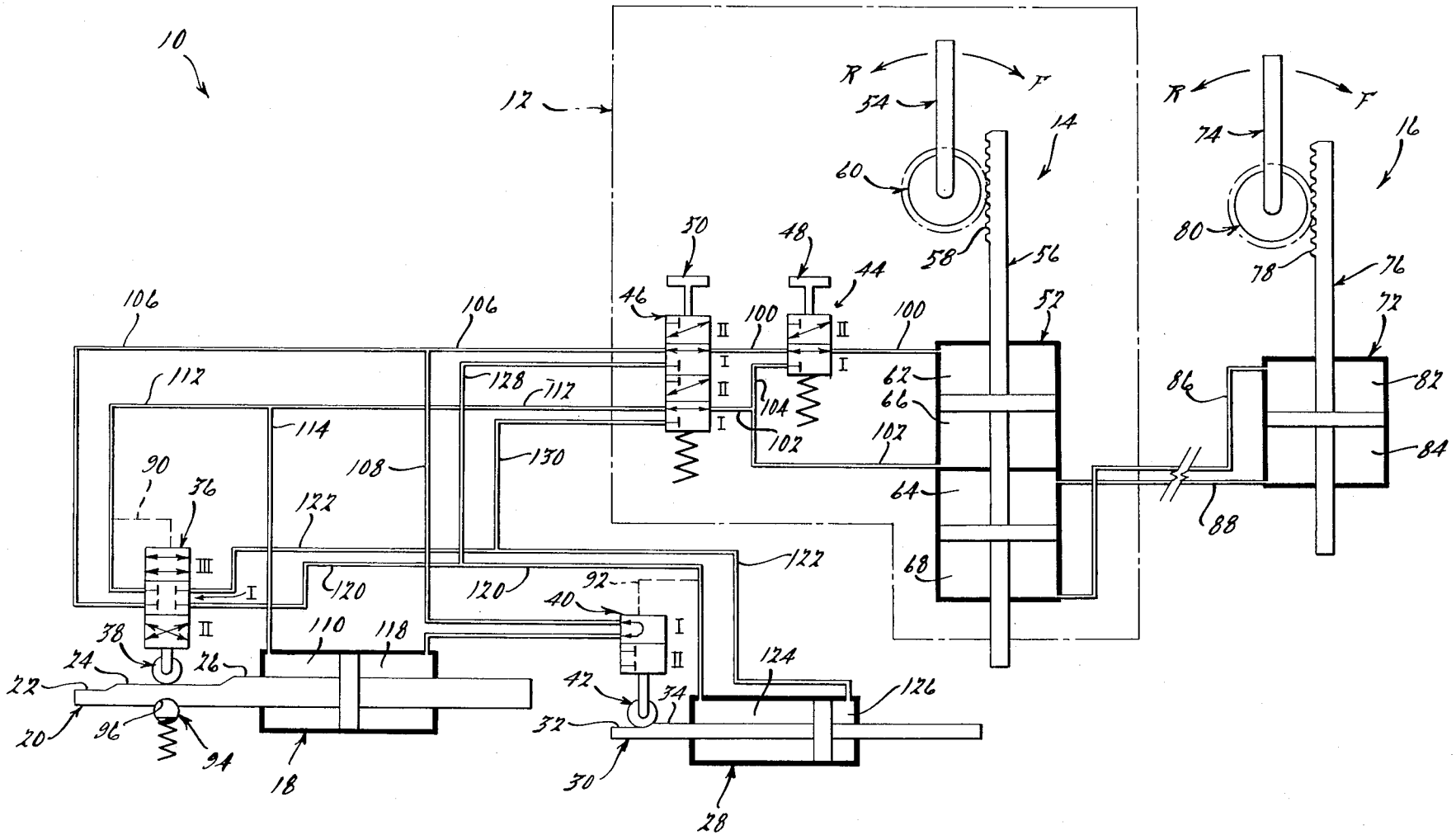
10
12
14
16
18
20
22
24
26
28
30
32
34
36
38
40
42
44
46
48
50
52
54
56
58
60
62
64
66
68
70
72
74
76
78
80
82
84
86
88
90
92
94
96
100
102
104
106
108
110
112
114
116
118
120
122
124
126
128
130
F
R
I
II
III

MARINE ENGINE THROTTLE/TRANSMISSION HYDRAULIC ACTUATOR

BACKGROUND OF THE INVENTION

The instant invention relates to single-lever engine throttle and transmission control devices used on water craft to allow single or multiple station operator control over the rotational direction and speed of a driven propeller.

The life of a transmission used in marine applications is severely reduced when its gears are engaged or disengaged at engine speeds above "idle." Hence, the recommended practice is to adjust the engine throttle to the idle position prior to "shifting" the transmission. The prior art teaches the use of single- and dual-lever engine throttle/transmission control devices to allow remote operator control of engine throttle and transmission settings. With a dual-lever system, the throttle and transmission are operated independently, each with its own control lever. Hence, in order to prevent transmission damage the operator must remember to return the throttle lever to the idle position prior to engagement or disengagement of the transmission. In contrast, with the single-lever design, by moving the actuator lever in a first direction, usually forward toward the bow of the vessel, the operator first engages the transmission in "forward," and then increases engine speed proportionally to such forward lever movement. When the operator attempts to return to neutral transmission position, he must first move the single lever back through idle throttle before the single-lever mechanism will disengage the transmission. Similarly, in moving the control lever aft, the transmission is first engaged in "reverse," only then to be followed by increasing engine throttle. And, again, when returning to neutral transmission from the condition of reverse with throttle up, the operator automatically reduces throttle to the idle position prior to disengagement of the transmission. Thus, the single-lever control system automatically ensures idle throttle when shifting.

There is frequently the need to provide engine throttle and transmission control from two or more stations, with each lever moving in sync with the corresponding lever of the other stations. Additionally, to be successful in the marketplace, an engine throttle and transmission control system must incorporate means to increase engine throttle while the transmission remains in "neutral" to facilitate engine starting and warm-up.

The prior art teaches single- or multi-station use of single-lever electrically operated selsyns and mechanical systems employing push-pull cables. However, electrically dependent systems are particularly vulnerable to power interruptions and other electrical system malfunctions; multiple station mechanical systems employing push-pull cables are cumbersome and complicated, requiring elaborate routing schemes to properly synchronize the various control stations, as well as complicated mechanical lock-out systems to enable increased engine throttle while in neutral. Alternatively, the prior art teaches multi-station dual-lever hydraulic control systems which feature high reliability and ease of control line routing. Unfortunately, hydraulic systems are not available in the more desirable single-lever design.

SUMMARY OF THE INVENTION

The invention relates to a single or multiple station single-lever hydraulic control system for a marine engine throttle and transmission having high reliability, flexible control lines that are easily routed throughout the vessel, and means for increasing engine throttle while the transmission is maintained in "neutral." The instant invention accomplishes this purpose by mechanically sequencing the actuation of the components of the hydraulic control system.

BRIEF DESCRIPTION OF THE DRAWING

The drawing comprises a schematic of the marine engine and transmission hydraulic control system of the instant invention. The system as shown produces an idling engine throttle and a "neutral" transmission.

DETAILED DESCRIPTION OF THE PREFERRED EMBODIMENT OF THE INVENTION

As illustrated schematically in the FIGURE, a hydraulic system 10 in accordance with an exemplary constructed embodiment of the instant invention comprises a control console 12 which includes a pump assembly 14; a second, auxiliary control pump assembly 16; a reciprocating bidirectional non-differential transmission control cylinder 18 (hereinafter transmission cylinder 18) having an otuput shaft 20 provided with surfaces 22, 24, and 26, to be mechanically connected to a transmission control lever (not shown); a reciprocating bidirectional non-differential throttle actuator cylinder 28 (hereinafter throttle cylinder 28) having an output shaft 30 provided with surfaces 32 and 34, to be mechanically connected to an engine throttle (not shown); a three-way bidirectional throttle cylinder sequencing control valve 36 (hereinafter throttle valve 36), the position of which is adjusted by a cam 38 attached thereto; and a two-way bidirectional transmission cylinder sequencing control valve 40 (hereinafter transmission valve 40), the position of which is similarly adjusted by a cam 42 attached thereto. The control console 12 also includes a two-way bidirectional system bypass valve 44, and a two-way bidirectional bypass valve 46 for avoiding the sequencing dictates of the throttle valve 36 (hereinafter sequencing bypass valve 46). The springreturned bypass valves 44 and 46 are provided with push buttons 48 and 50, respectively, for manual activation.

The pump assembly 14 of the control console 12 comprises a dual cylinder bidirectional non-differential pump 52 and a control lever 54 engaged with the input shaft 56 thereof by means of a rack 58 and pinion 60. The movement of the lever 54 about its point of attachment produces linear displacement of the input shaft 56, thereby pressurizing the fluid within chambers 62 and 64, or chambers 66 and 68, of the pump 52, depending upon the direction of lever deployment. Similarly, the auxiliary pump assembly 16 comprises a single cylinder bidirectional nondifferential pump 72 and a control lever 74 engaged with the input shaft 76 thereof by means of a rack 78 and pinion 80. Thus, the movement of the lever 74 about its pivot point produces linear displacement of the input shaft 76, thereby pressurizing the fluid within pump chambers 82 or 84, depending upon the direction of lever movement. The auxiliary pump chambers 82 and 84 communicate with console pump chambers 68 and 64, respectively, via hydraulic fluid lines 86 and 88, respectively. The volumes of pump chambers 82, 84, 68, and 64 are such that displacement of the auxiliary pump input shaft 56 generated by movement of the auxiliary pump lever 74 produces an identical displacement of the input shaft 56 of the console pump 52.

As shown in the figure, the position of the throttle valve 36 is mechanically dictated by the surface 22, 24, or 26 of the transmission cylinder shaft 20 with which the valve cam 38 engages. The engagement therebetween is ensured by fluid pressure supplied by pilot line 90. Similarly, the transmission valve 40 is positioned by the throttle cylinder output shaft 30, with the transmission valve cam 42 engaging with shaft surface 32 or 34. Again, the hydraulic pressure provided by pilot line 92 ensures positive tracking of the surface 32 or 34 of the output shaft 30 by the cam 42. A detent 94, herein disposed in a spring-loaded ball, is employed in combination with a notch 96 on the throttle cylinder output shaft 30 to assist the operator in locating and maintaining the transmission in "neutral."

Hydraulic fluid is conducted to and from console pump chambers 62 and 66 by fluid lines 100 and 102, respectively, to and from the sequencing bypass valve 46 and, with the aid of branch line 104, to the system bypass valve 44. The hydraulic fluid conducted by line 100 is normally routed through the sequencing bypass valve 46 to and from the throttle valve 36 and the transmission valve 40 via lines 106 and 108, respectively. Similarly, the fluid conducted by line 102 is normally routed through the sequencing bypass valve 46 to and from the throttle valve 36 and a chamber 110 of the transmission control cylinder 18 via lines 112 and 114, respectively. The fluid conducted by line 108 and through the transmission valve 40 when in the open position is conducted by line 116 to the other chamber 118 of the transmission control cylinder 18. The transmission valve 40 is "open" only when the cam 42 attached thereto is engaging the throttle cylinder output shaft 30 at surface 32, which corresponds to the "idle" engine throttle position. Thus, the output shaft 20 of the transmission control cylinder 18 is allowed to move, operating to engage or disengage the transmission, only when the engine is idling. The damage to the transmission is thereby minimized.

The throttle valve 36 is in the closed position, designated valve position "I" in the figure, when the cam 38 attached thereto is engaging the transmission cylinder output shaft 20 at surface 24, the center of which corresponds to a "neutral" transmission. The elimination of fluid flow through the throttle valve 36 when in position "I" prevents an increase in throttle above "idle" when the transmission is not fully engaged in either forward or reverse gears. When the transmission is fully engaged in "forward" by the movement of the output shaft 20 resulting from the transfer of fluid into cylinder chamber 110, the cam 38 of the throttle valve 36 engages the output shaft 20 at surface 22, thereby switching the valve 36 to position "II." Fluid lines 106 and 120, and lines 112 and 122, are thus connected. The console pump chambers 62 and 66 are thus brought into communication with throttle cylinder chambers 124 and 126, respectively, to produce displacement of the cylinder's output shaft 30 upon further displacement of the pump's input shaft 56. Alternatively, when the transmission is fully engaged in "reverse" by movement of the output shaft 20 resulting from the transfer of fluid into chamber 118, the cam 38 of the throttle valve 36 engages the output shaft 20 at surface 26, thereby switching the valve 36 to position "III." Fluid lines 106 and 122, and lines 112 and 120, are thus connected. The console pump chambers 62 and 66 are thus brought into communication with throttle cylinder chambers 126 and 124, respectively, also producing displacement of the cylinder's output shaft 30 upon further displacement of the pump's input shaft 56. Thus, the output shaft 30 of the throttle cylinder 28 is allowed to move, operating to increase or decrease the engine throttle setting, only when the throttle valve cam 38 is engaging transmission cylinder output shaft surface 22 or 26. Hence, engine throttle cannot be increased above "idle" prior to full transmission engagement in either "forward" or "reverse."

The continuous push-button activation of the sequencing bypass valve 46, to position "II" as designated in the figure, provides fluid communication between console pump chambers 62 and 66, and throttle cylinder chambers 124 and 126, respectively, via lines 100, 128 and 120, and lines 102, 130 and 122, respectively. Hence, with the system's automatic sequencing of throttle cylinder 28 disabled, transmission engagement is no longer a precondition to engine throttle increase. Hence, the engine throttle may be "gunned" while the transmission is in "neutral" to facilitate engine starting/warm-up.

The push-button activation of the system bypass valve 44, to position "II" as designated in the figure, allows adjustment of the lever 54 of the console pump assembly 14 about its pivot point to any desired position without communicating fluid to either of the system's hydraulic cylinders 18 and 28. The console lever 54 may therefore be adjusted to visually correspond with engine throttle and transmission settings. Hence, with the direction of travel of the console lever 54 aligned with the keel of the vessel, the lever 54 may be adjusted so that lever orientation normal to the water surface indicates idle throttle with the transmission in "neutral;" partial lever deployment towards the bow indicates idle throttle with the forward gear engaged; full forward lever deployment indicates full throttle in "forward;" partial lever deployment aft indicates idle throttle with the reverse gear engaged; and full rearward lever deployment indicates full throttle in "reverse."

The operation of the hydraulic control system of the instant invention, where the console pump lever 54 and auxiliary pump lever 74 are aligned and adjusted as detailed hereinabove, is as follows:

The console pump lever 54 is adjusted with the aid of the detent 94 so as to locate "neutral" transmission. The lever 54 is deployed in the direction of the bow of the vessel, designated direction "F" in the figure, while activating the sequencing bypass valve 46 by depressing push button 50. The engine throttle setting is thereby increased, as fluid is transferred from pump chamber 66 into throttle cylinder chamber 126, and from throttle cylinder 124 back to pump chamber 62. The engine is then started. Engine warm-up is also facilitated by this increased throttle setting. The lever 54 is then returned to its original "neutral" transmission and idle throttle position while the push button 50 is again manually depressed. The sequencing bypass valve 46 must be activated in order to move the lever 54 back to its original position, as both the throttle valve 36 and the transmission valve 40 are "closed," remaining in positions "I" and "II" in the figure, respectively. As there can be no fluid transfer within the system under this condition, both cylinders 18 and 28, and both pumps 52 and 72, are immotile. The system thereby ensures the deliberate reduction of engine throttle to the idle setting prior to effectuating transmission engagement.

As the console pump lever 54, or the auxiliary pump lever 74, is moved forward, in direction "F" in the figure, the fluid within the pump chamber 66 is transferred into transmission cylinder chamber 110. Fluid within cylinder chamber 118 is simultaneously transferred through the open transmission valve 40 to pump chamber 62. The transmission is thus engaged in forward gear as throttle valve cam 38 reaches transmission cylinder output shaft surface 22. The throttle valve 36 switches to position "II." The fluid from pump chamber 66 is thus directed into throttle cylinder chamber 126, and from cylinder chamber 124 back to pump chamber 62. As the throttle cylinder output shaft 30 begins to move, the transmission valve cam 42 begins to engage surface 34 of the output shaft 30, and the transmission valve 40 thereby switches to the closed position, position "II" in the figure. The fluid circuit between the pump 14 and the transmission cylinder 18 is thus closed, and the transmission cylinder 18 becomes immotile. Further deployment of the pump lever 54 or 74 in direction "F" will produce an additional increase in engine throttle, as fluid is directed from pump chamber 66 into throttle cylinder chamber 126, and from cylinder chamber 124 back to pump chamber 62. Full throttle is achieved when full throttle cylinder 28 travel is reached.

To return to idle engine throttle and neutral transmission settings from full engine throttle in forward gear, the console pump lever 54, or the auxiliary pump lever 74 is merely moved aft, in direction "R" in the figure. The transmission valve 40 is "closed" as long as the engine throttle is above "idle." Thus, the continuous rearward deployment of the lever 54 or 74 transfers fluid from pump chamber 62 through throttle valve 36 into throttle cylinder chamber 124, and from cylinder chamber 126 back to pump chamber 66. When the engine throttle is reduced to "idle," the transmission valve cam 42 begins to engage surface 32 of the throttle cylinder output shaft 30. The transmission valve 40 is thus switched to the open position, and the output of pump chamber 62 is diverted through the valve 40 into transmission cylinder chamber 118. Fluid is returned from cylinder chamber 110 back to pump chamber 66. As the transmission cylinder output shaft 20 begins to move, the transmission is disengaging from forward gear. The throttle valve cam 38 begins to engage surface 24 of the transmission cylinder output shaft 20, and the valve 36 is thereby switched back to its closed position, position "I" in the figure. Fluid communication between the pump 14 and the throttle cylinder 28 is thus terminated. The remaining movement of lever 54 or 74 in direction "R" back to its original vertical orientation transfers fluid from pump chamber 62 into transmission cylinder chamber 118, and from cylinder chamber 110 back to pump chamber 66, producing engagement between the detent 94 and transmission cylinder output shaft notch 96. The operator thus receives tactile confirmation that "neutral" has been securely established.

Similarly, as the console pump lever 54, or the auxiliary pump lever 74, is moved aft, in direction "R" in the figure, from the idle engine throttle and neutral transmission setting, the fluid within the pump chamber 62 is transferred through the open transmission valve 40 into transmission cylinder chamber 118. Fluid within cylinder chamber 110 is simultaneously transferred back to pump chamber 66. The transmission is thus engaged in reverse gear as throttle valve cam 38 reaches transmission cylinder output shaft surface 26. The throttle valve 36 switches to position "III." The fluid from pump chamber 62 is thus directed through the throttle valve 36 to throttle cylinder chamber 126, and from cylinder chamber 124 back to pump chamber 66. As the throttle cylinder output shaft 30 begins to move, the transmission valve cam 42 begins to engage surface 34 of the output shaft 30, and the transmission valve 40 thereby switches to the closed position, position "II" in the figure. The fluid circuit between the pump 14 and the transmission cylinder 18 is thus closed, and the transmission cylinder 18 becomes immotile. Further deployment of the pump lever 54 or 74 in direction "R" will produce an additional increase in engine throttle, as fluid is directed from pump chamber 62 into throttle cylinder chamber 126, and from cylinder chamber 124 back to pump chamber 66. Full throttle is achieved when full throttle cylinder 28 travel is reached.

Again, to return to idle engine throttle and neutral transmission settings from full engine throttle in reverse gear, the console pump lever 54, or the auxiliary pump lever 74 is merely moved forward, in direction "F" in the figure. The transmission valve 40 is "closed" as long as the engine throttle is above "idle." Thus, the continuous forward deployment of the lever 54 or 74 transfers fluid from pump chamber 66 into throttle cylinder chamber 124, and from cylinder chamber 126 through throttle valve 36 back to pump chamber 62. When the engine throttle is reduced to "idle," the transmission valve cam 42 begins to engage surface 32 of the throttle cylinder output shaft 30. The transmission valve 40 is thus switched to the open position, and the circuit between the pump 14 and the transmission cylinder 18 is thus completed. The output of pump chamber 66 is conducted into transmission cylinder chamber 110, and from cylinder chamber 118 through the transmission control valve 40 back to pump chamber 62. As the transmission cylinder output shaft 20 begins to move, the transmission is disengaging from reverse gear. The throttle valve cam 38 begins to engage surface 24 of the transmission cylinder output shaft 20, and the valve 36 is thereby switched back to its closed position, position "I" in the figure. Fluid communication between the pump 14 and the throttle cylinder 28 is thus terminated. The remaining movement of lever 54 or 74 in direction "F" back to its original vertical orientation transfers fluid from pump chamber 66 into transmission cylinder chamber 110, and from cylinder chamber 118 back to pump chamber 62, producing engagement between the detent 94 and transmission cylinder output shaft notch 96. The operator once again receives tactile confirmation that "neutral" has been securely established.

The instant invention contemplates the substitution of valves, pumps, and motors described hereinabove with others producing the same effects. For example, a plurality of two-way bidirectional valves may be substituted for the single three-way valve 36 of the preferred embodiment. Similarly, the auxiliary pump 72 and the portion of the console pump 52 communicating therewith may, for example, be of differential, or rotary, design.

While the preferred embodiment of the invention has been disclosed, it should be appreciated that the invention is susceptible of modification without departing from the spirit of the invention or the scope of the subjoined claims.

I claim:

1. In a propulsion system comprising
an engine having a throttle, and a transmission connected to said engine, the improvement comprising a hydraulic system for controlling the operation of said throttle and said transmission, said hydraulic system comprising a reciprocating bidirectional pump having an input shaft;

a first reciprocating bidirectional motor having an output shaft connected to said throttle;

a second reciprocating bidirectional motor having an output shaft connected to said transmission;

first fluid control means mechanically engaged with the output shaft of said first motor, whereby fluid communication between said pump and said second motor is controlled by the position of the output shaft of said first motor; and second fluid control means mechanically engaged with the output shaft of said second motor, whereby fluid communication between said pump and said first motor is controlled by the position of the output shaft of said second motor.

2. The hydraulic system of claim 1 wherein the output shaft of said first motor is provided with a stepped surface and said first fluid control means mechanically engaged with said output shaft comprises a two-way bidirectional valve having a control element; and a cam connected to the control element of said valve and engaged with said output shaft, such engagement to be maintained by a pilot fluid pressure, whereby said cam operates said valve by following the stepped surface of said output shaft.

3. The hydraulic system of claim 1 wherein the output shaft of said second motor is provided with a stepped surface and said second fluid control means mechanically engaged with said output shaft comprises a three-way bidirectional valve having a control element; and a cam connected to the control element of said valve and engaged with said output shaft, such engagement to be maintained by a pilot fluid pressure, whereby said cam operates said valve by following the stepped surface of said output shaft.

4. The hydraulic system of claim 1 wherein the output shaft of said second motor is provided with a stepped surface and said second fluid control means mechanically engaged with said output shaft comprises a plurality of two-way bidirectional valves, each of said valves having a control element; and a cam connected to the control element of each of said valves and engaged with said output shaft, such engagement to be maintained by a pilot fluid pressure, whereby said cams operate said valves by following the stepped surface of said output shaft.

5. The hydraulic system of claim 1 including a second reciprocating bidirectional pump having an input shaft; and a third reciprocating bidirectional motor having an output shaft connected to the input shaft of said first pump and in fluid communication with said second pump, whereby movement of the input shaft of said second pump produces like movement of the input shaft of said first pump.

6. The hydraulic system of claim 1 including third fluid control means, whereby fluid communication between said pump and said first motor is achieved without regard to the position of the output shaft of said second motor.

* * * * *